US010967653B2

(12) United States Patent
Abe et al.

(10) Patent No.: US 10,967,653 B2
(45) Date of Patent: Apr. 6, 2021

(54) THERMAL PRINTER

(71) Applicant: ALPS ALPINE CO., LTD., Tokyo (JP)

(72) Inventors: Yoshibumi Abe, Miyagi (JP); Zenko Motoki, Miyagi (JP); Akira Kabamoto, Miyagi (JP)

(73) Assignee: ALPS ALPINE CO., LTD., Tokyo (JP)

( * ) Notice: Subject to any disclaimer, the term of this patent is extended or adjusted under 35 U.S.C. 154(b) by 0 days.

(21) Appl. No.: 16/815,159

(22) Filed: Mar. 11, 2020

(65) Prior Publication Data

US 2020/0207124 A1 Jul. 2, 2020

Related U.S. Application Data

(63) Continuation of application No. PCT/JP2018/028873, filed on Aug. 1, 2018.

(30) Foreign Application Priority Data

Sep. 28, 2017 (JP) ..... JP2017-188872

(51) Int. Cl.
*B41J 25/312* (2006.01)
*B41J 11/04* (2006.01)
*B41J 2/32* (2006.01)

(52) U.S. Cl.
CPC ..... *B41J 11/04* (2013.01); *B41J 2/32* (2013.01); *B41J 25/312* (2013.01)

(58) Field of Classification Search
CPC ..... B41J 11/04; B41J 2/32; B41J 11/20; B41J 11/14; B41J 25/308; B41J 25/3082; B41J 25/3086; B41J 25/3088; B41J 25/312
See application file for complete search history.

(56) References Cited

U.S. PATENT DOCUMENTS 5,014,135 A 5/1991 Ijuin et al.
5,997,192 A * 12/1999 Martinez ..... B41J 11/46 235/449

(Continued)

FOREIGN PATENT DOCUMENTS

JP S63-198554 U 12/1988
JP H04-308780 10/1992

(Continued)

OTHER PUBLICATIONS

Machine translation of JP 06-207503, published on Sep. 1994 (Year: 1994).*

(Continued)

*Primary Examiner* — Huan H Tran
(74) *Attorney, Agent, or Firm* — IPUSA, PLLC

(57) ABSTRACT

A thermal printer includes a frame including sidewalls; a platen roller supported by the frame, through bearings, the platen roller being configured to rotate with a rotational shaft; a thermal head disposed opposite the platen roller; a support member for supporting the thermal head, the support member being configured to be pivoted with respect to the frame; and an adjustment mechanism disposed between the rotational shaft of the platen roller and the thermal head, the adjustment mechanism allowing a distance between the rotational shaft of the platen roller and the thermal head to be adjusted, while contacting at least one from among components of the platen roller and components of the thermal head, so that a gap between the thermal head and the platen roller is adjusted.

3 Claims, 14 Drawing Sheets

(56) References Cited

U.S. PATENT DOCUMENTS

| | | | | |
|---|---|---|---|---|
| 6,155,731 | A | 12/2000 | Bertalan et al. | |
| 6,183,148 | B1 * | 2/2001 | Martinez | B41J 2/32 400/120.17 |
| 7,889,218 | B2 | 2/2011 | Yamamoto | |
| 10,357,984 | B2 * | 7/2019 | Tsuchiya | B41J 11/70 |
| 2018/0079242 | A1 | 3/2018 | Tsuchiya et al. | |

FOREIGN PATENT DOCUMENTS

| | | |
|---|---|---|
| JP | H06-270502 | 9/1994 |
| JP | H06-270503 | 9/1994 |
| JP | 3016172 U | 9/1995 |
| JP | H10-114091 | 5/1998 |
| JP | 2009-119733 | 6/2009 |
| JP | 2014-065210 | 4/2014 |
| JP | 2016-203382 | 12/2016 |

OTHER PUBLICATIONS

Machine translation of JP 04-308780, published on Oct. 1992. (Year: 1992).*

International Search Report for PCT/JP2018/028873 dated Oct. 9, 2018.

Japanese Office Action for 2019-544363 dated Feb. 2, 2021.

* cited by examiner

THERMAL PRINTER

CROSS-REFERENCE TO RELATED APPLICATION

This application is a continuation application of International Application No. PCT/JP2018/028873 filed on Aug. 1, 2018, and designated the U.S., which is based upon and claims priority to Japanese Patent Application No. 2017-188872, filed on Sep. 28, 2017, the entire contents of which are incorporated herein by reference.

BACKGROUND OF THE INVENTION

1. Field of the Invention

The present disclosure relates to a thermal printer.

2. Description of the Related Art

In order to form an image on a thermal paper, thermal printers have employed a configuration in which the thermal paper is interposed between a thermal head and a platen roller to be pressed against the thermal head, and in which the pressed thermal paper is heated by heating elements provided in the thermal head.

For such a thermal printer, a gap between a thermal head and a platen roller is adjusted to appropriate spacing, so that a thermal paper can be interposed under suitable pressure. Thereby, quality of an image formed on the thermal paper can be improved, or the thermal paper can be conveyed appropriately. In this regard, with respect to a thermal printer according to related art, a technique for adjusting a gap between a thermal head and a platen roller is disclosed.

For example, Japanese Unexamined Patent Application Publication No. 2009-119733, which is hereafter referred to as Patent document 1, discloses a thermal printer. In the thermal printer, a tip portion of each screw element provided in a member for holding a thermal head contacts with an upper surface of a frame in which a platen roller is disposed. In accordance with each screw element being rotated, an amount of a given screw element protruding is adjusted, so that a size of a gap between the thermal head and the platen roller can be thereby adjusted.

SUMMARY

A thermal printer according to one embodiment of the present disclosure includes a frame including sidewalls; a platen roller supported by the frame, through bearings, the platen roller being configured to rotate with a rotational shaft; a thermal head disposed opposite the platen roller; a support member for supporting the thermal head, the support member being configured to be pivoted with respect to the frame; and an adjustment mechanism disposed between the rotational shaft of the platen roller and the thermal head, the adjustment mechanism allowing a distance between the rotational shaft of the platen roller and the thermal head to be adjusted, while contacting at least one from among components of the platen roller and components of the thermal head, so that a gap between the thermal head and the platen roller is adjusted.

DESCRIPTION OF THE PREFERRED EMBODIMENTS

For a thermal printer disclosed in Patent document 1, the inventors of this application have recognized the following: screw elements used as adjustment means contact with an upper surface of a frame. In this example, even if the gap described above is adjusted to an appropriate size, due to a case of the frame being deformed, etc. with long-term use of the thermal printer, the gap may be out of the appropriate size, or an angle at which the thermal head and a sheet front of the thermal paper meet may be out of an appropriate angle. In this case, quality of an image formed on a given thermal paper may be decreased, or a given thermal paper may be unable to be conveyed suitably. In light of the issue described above, a thermal printer is provided whereby it is possible to sufficiently accurately maintain a size of a gap between a thermal head and a platen roller, as well as an angle at which the thermal head and a sheet front of the thermal paper meet.

One or more embodiments will be hereinafter described with reference to the drawings.

(Basic Configuration of Thermal Printer 100)

First, a basic configuration of a thermal printer 100 according to one embodiment will be described with reference to FIGS. 1 to 5.

Figure 1:
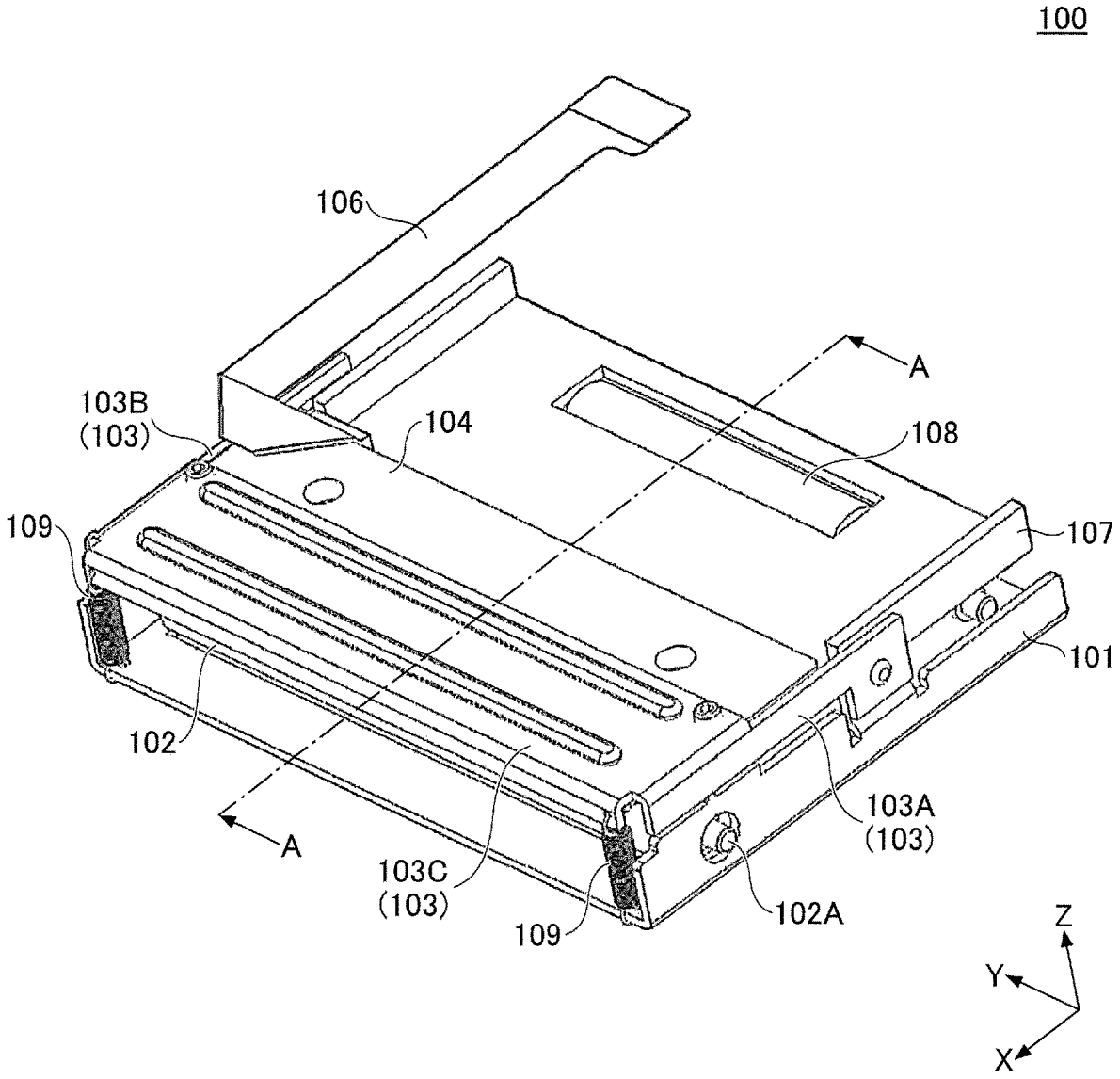
FIG. 1 is an external perspective view of an example of a thermal printer according to one embodiment.
Figure 2:
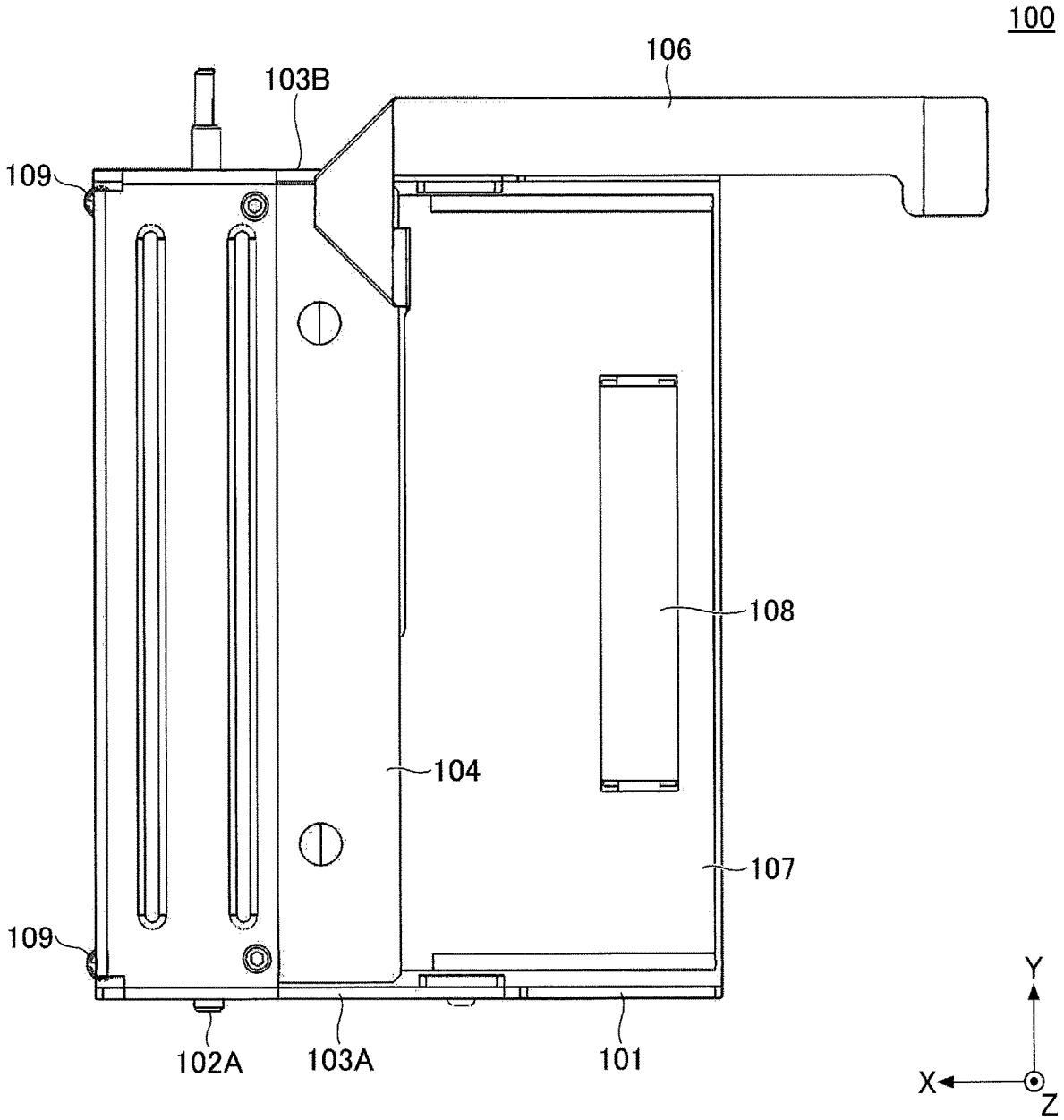
FIG. 2 is a plan view of an example of the thermal printer according to one embodiment.
Figure 3:
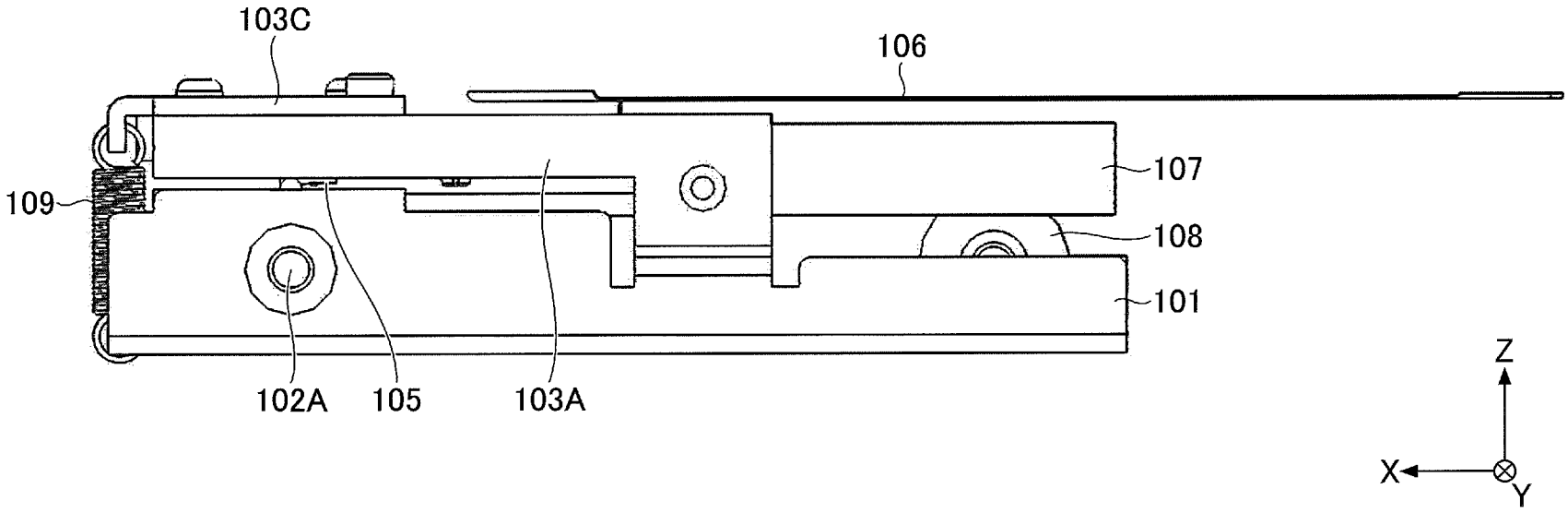
FIG. 3 is a side view of an example of the thermal printer according to one embodiment.
Figure 4:
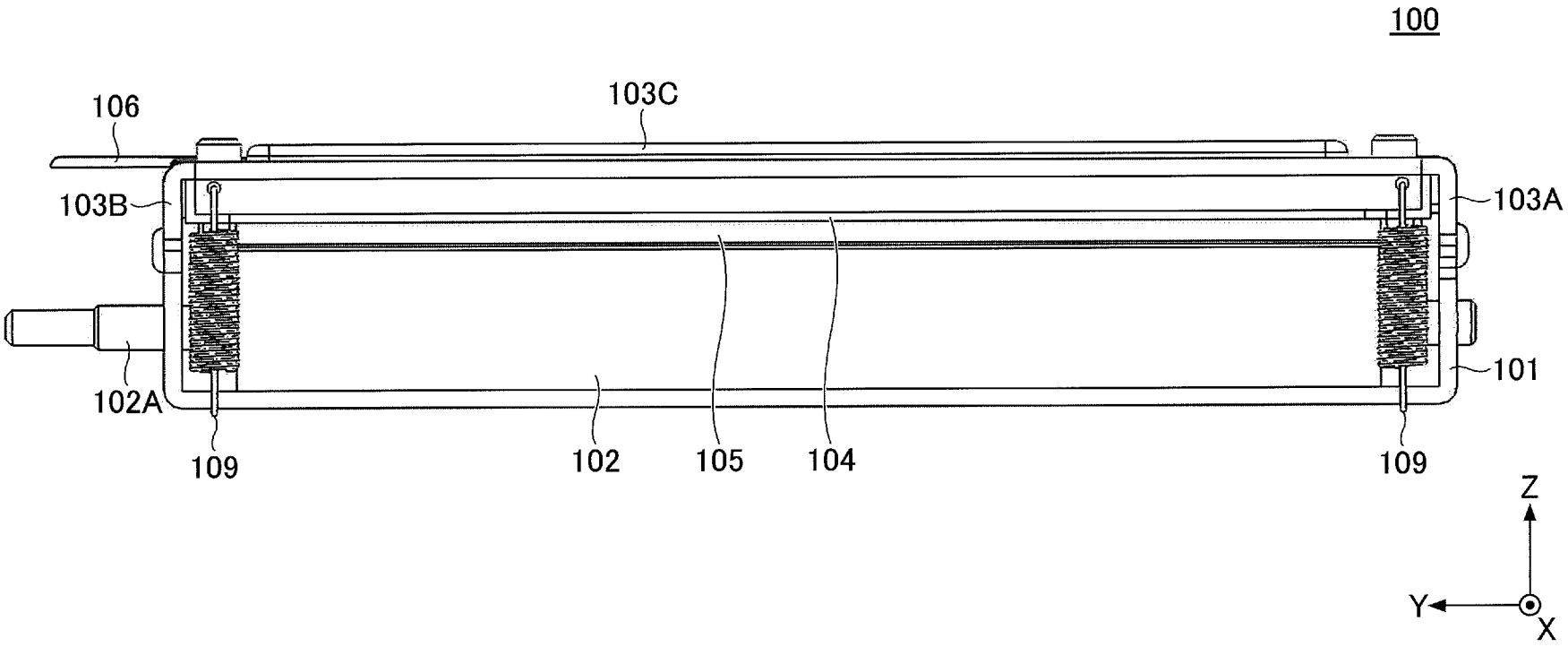
FIG. 4 is a front view of an example of the thermal printer according to one embodiment.
Figure 5:
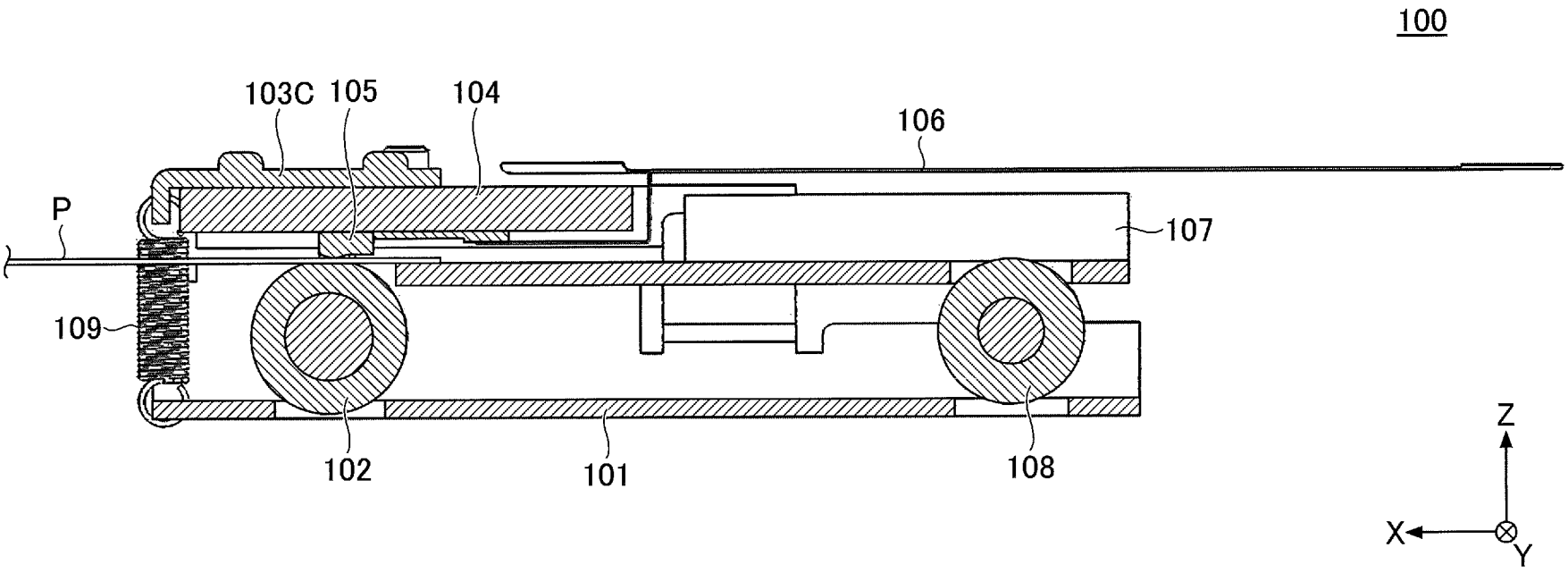
FIG. 5 is a perspective view taken along the A-A line of the thermal printer in FIG. 1.

FIG. 1 is an external perspective view of an example of a thermal printer 100 according to one embodiment. FIG. 2 is a plan view of an example of the thermal printer 100 according to one embodiment. FIG. 3 is a side view of an example of the thermal printer 100 according to one embodiment. FIG. 4 is a front view of an example of the thermal printer 100 according to one embodiment. FIG. 5 is a perspective view taken along the A-A line of the thermal printer 100 in FIG. 1. Note that in the following description, for illustrative purposes, in the drawings, a Z-axis direction refers to a longitudinal direction or a vertical direction; an X-axis direction (direction in which a thermal paper P is conveyed) refers to a forward-and-backward direction; and a Y-axis direction (direction perpendicular to a direction in which a thermal paper P is conveyed) refers to a lateral direction or a horizontal direction.

The thermal printer 100 illustrated in FIGS. 1 to 5 is a thermal printer. In the thermal printer, a thermal paper P is pressed against a thermal head 105, and then the pressed paper P is heated by heating elements provided in the thermal head 105. Thereby, an image can be formed on the thermal paper P.

As illustrated in FIGS. 1 to 5, the thermal printer 100 includes a frame 101; a platen roller 102; a support member 103 (which includes arm portions 103A and 103B, and a connecting portion 103C); and a plate 104. The thermal printer 100 also includes a thermal head 105; an FPC (Flexible Printed Circuit) 106; a paper feed guide 107; a paper feed roller 108; and crimping springs 109.

The frame 101 is formed by processing a metal plate, and has a tray-like member that has an approximately thin rectangular shape. The frame 101 has a bottom portion that is rectangular in a plan view when viewed from above. The frame 101 also has respective sidewalls that are vertically formed along left and right edges of the bottom portion.

The platen roller 102 is a cylindrical member that extends in a lateral width direction (Y-axis direction in the figures), between respective sidewalls on right and left sides of the frame 101. With respect to the platen roller 102, both ends of a rotational shaft 102A are pivotally supported by respective bearings (not illustrated) attached to the right and left sidewalls of the frame 101. The platen roller 102 is disposed opposite the thermal head 105. A thermal paper P (see FIG. 5) is interposed in a gap between the platen roller 102 and the thermal head 105. Thereby, a sheet front of the thermal paper P can be pressed against the thermal head 105. Further, the platen roller 102 rotates in response to driving a motor (e.g., a stepping motor, etc. not illustrated in the figures). Thereby, the platen roller 102 can convey the thermal paper P in a predetermined conveyance direction (positive X-axis direction in the figures). For example, a roller portion of the platen roller 102 is formed of an elastic material such as rubber. Further, for example, the rotational shaft 102A of the platen roller 102 is formed of a relatively rigid material such as metal. Note that the platen roller 102 is not limited to a roller that rotates in response to driving a motor. The platen roller 102 may rotate in accordance with a thermal paper P being conveyed.

The support member 103 is a member formed by processing a metal plate. The support member 103 supports the plate 104 and the thermal head 105. The support member 103 can rotate in a vertical direction (Z-axis direction in the figures) with respect to the frame 101. Specifically, the support member 103 includes two right and left arm portions 103A and 103B and includes a connecting portion 103C. The two arm portions 103A and 103B each extend, from the approximate middle of the frame 101 in a forward-and-backward direction (X-axis direction in the figures), toward a conveyance direction (positive X-axis direction in the figures) of a thermal paper P, to be along an upper periphery of a given sidewall of the frame 101. Each of the two arm portions 103A and 103B is in the form of an elongated flat plate. The arm portions 103A and 103B are vertically disposed such that respective surfaces are almost vertically situated and are each approximately coplanar with a given sidewall surface of the frame 101. Tip portions of the respective two arm portions 103A and 103B are connected to each other, via the plate-like connecting portion 103C that has an approximately horizontal plane. The plate 104 and the thermal head 105 are attached to the bottom of the connecting portion 103C. Further, the two arm portions 103A and 103B are each pivotally supported at an end portion of a given arm portion, by a given sidewall of the frame 101. Thereby, the support member 103, which supports the plate 104 and the thermal head 105, can be pivoted at pivot points, in a vertical direction (Z-axis direction in the figures) with respect to the frame 101, the pivot points being defined by end portions of the two arm portions 103A and 103B.

The plate 104 is attached to the bottom of the connecting portion 103C that constitutes part of the support member 103. The plate 104 is a plate-like member that has an approximately horizontal plane. For example, the plate 104 is formed of a relatively rigid material such as metal.

At the bottom of the plate 104, the thermal head 105 is disposed opposite the platen roller 102. In the thermal head 105, a plurality of heating elements are arranged in a lateral width direction (Y-axis direction in the figures being a direction perpendicular to a conveyance direction in which a thermal paper P is conveyed). A slight gap is formed between the thermal head 105 and the platen roller 102, the gap being smaller than a thickness of the thermal paper P. For example, when a thermal paper P has a thickness of 0.25 mm, a gap of 0.15 mm is formed between the thermal head 105 and the platen roller 102. In such a manner, when a given thermal paper P is inserted between the thermal head 105 and the platen roller 102, a sheet front of the thermal paper P can be pressed against the thermal head 105, under appropriate pressure. In a manner such that the sheet front of the thermal paper P is pressed, the plurality of heating elements are controlled to generate heat based on a control signal output from an external circuit through the FPC 106, so that the thermal head 105 can thereby form an image on the thermal paper P.

The FPC 106 is a member that connects the thermal head 105 with an external circuit (not illustrated) in order to supply a control signal to the thermal head 105. The FPC 106 is a film member that has a structure in which one or more interconnects formed of a metal film are interposed between resin materials such as polyimide. The FPC 106 is flexible and thus can be bended.

The paper feed guide 107 and the paper feed roller 108 are disposed on a rear portion of the frame 101. A thermal paper P is placed on the paper feed guide 107. In accordance with rotation of the paper feed roller 108, the paper feed roller 108 transmits the thermal paper P placed on the paper feed guide 107, to a space between the platen roller 102 and the thermal head 105.

One end of each crimping spring 109 is hooked to a tip portion of the support member 103, and the other end of each crimping spring 109 is hooked to the frame 101. Thereby, each crimping spring 109 preloads the support member 103 downwardly such that a state of the support member 103 being closed is maintained. In such a state of the support member 103 being closed, a gap between the thermal head 105 and the platen roller 102 is maintained to have an appropriate size.

With respect to the thermal printer 100 in such a manner, a thermal paper P is fed into a gap between the thermal head 105 and the platen roller 102, through the paper feed guide 107 and the paper feed roller 108. Thereby, the thermal head 105 and the platen roller 102 sandwich a fed thermal paper P. In such a manner, a control signal corresponding to print data is input from an external circuit (not illustrated) to the thermal head 105, through the FPC 106. The plurality of heating elements of the thermal head 105 generate heat based on an input control signal, so that the thermal head 105 heats the thermal paper P. Thereby, the thermal head 105 forms an image corresponding to the print data, on the thermal paper P.

(Example of Adjustment Mechanism)

The thermal printer 100 according to one embodiment further includes an adjustment mechanism for adjusting a gap between a thermal head 105 and a platen roller 102, as well as the basic configuration described in FIGS. 1 to 5. For illustrative purposes, such an adjustment mechanism is not illustrated in FIGS. 1-5. Examples of the adjustment mechanism included in the thermal printer 100 will be specifically described below.

(First Example of Adjustment Mechanism)

Figure 6:
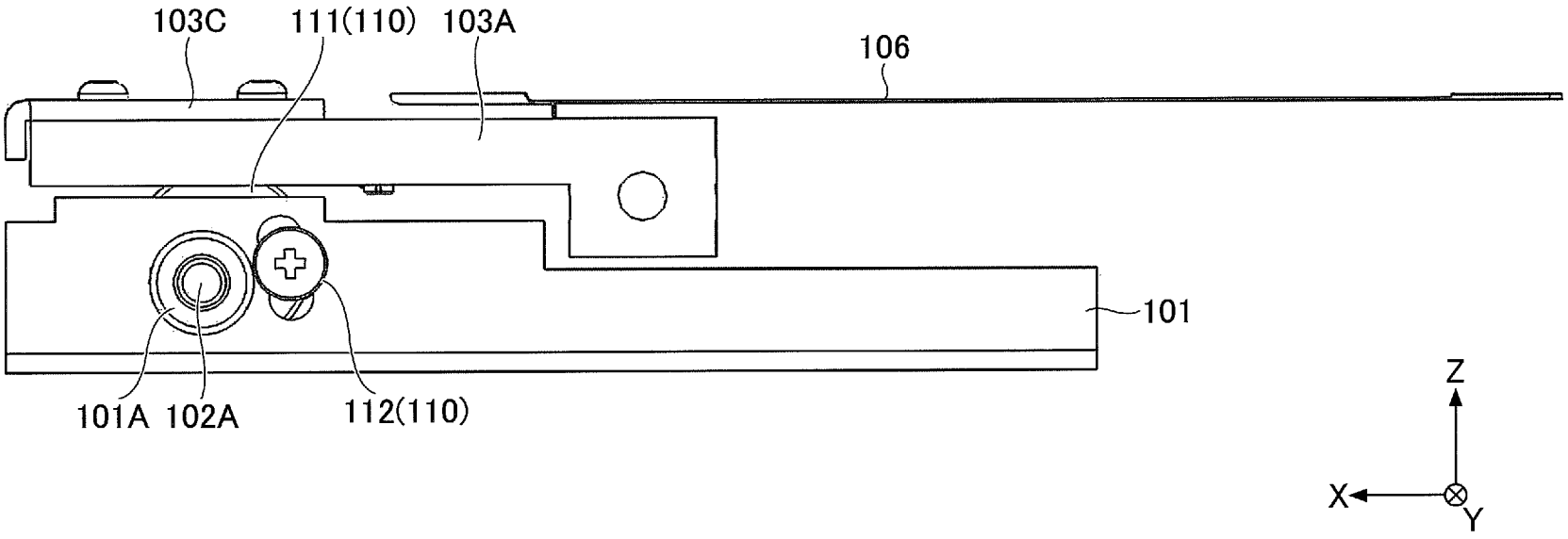
FIG. 6 is a side view of a first example of an adjustment mechanism included in the thermal printer according to one embodiment.
Figure 7:
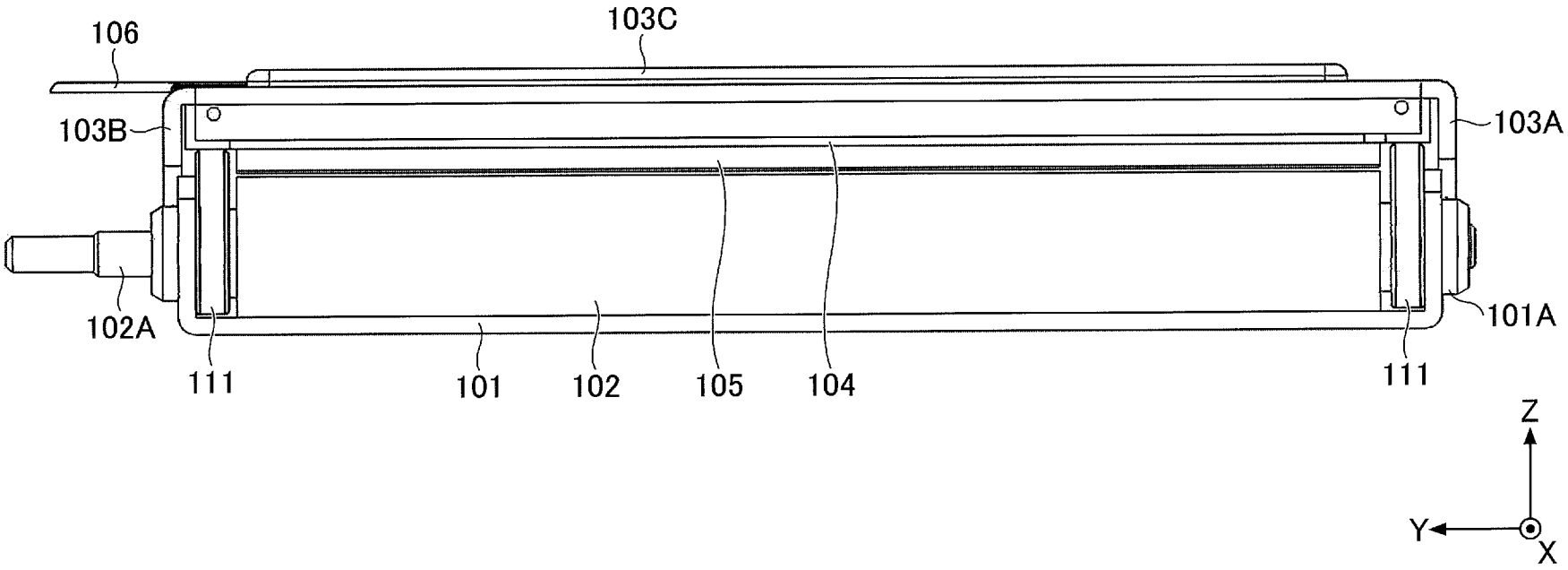
FIG. 7 is a front view of the first example of the adjustment mechanism included in the thermal printer according to one embodiment.
Figure 8:
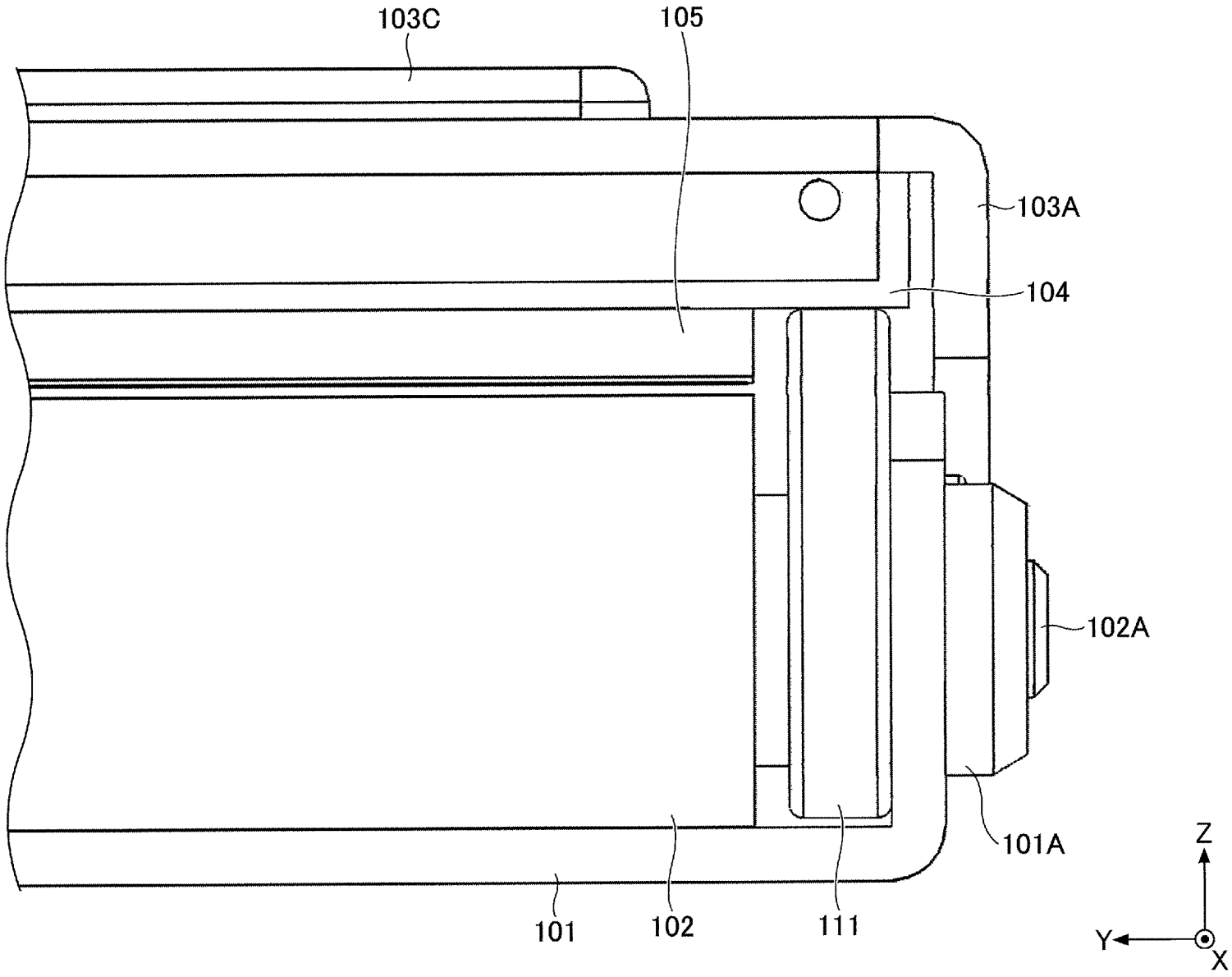
FIG. 8 is a partially enlarged view of the first example of the adjustment mechanism included in the thermal printer according to one embodiment.

First, a first example of an adjustment mechanism included in the thermal printer 100 will be described with reference to FIGS. 6 to 8. FIG. 6 is a side view of the first example of the adjustment mechanism included in the thermal printer 100 according to one embodiment. FIG. 7 is a front view of the first example of the adjustment mechanism included in the thermal printer 100 according to one embodiment. FIG. 8 is a partially enlarged view of the first example of the adjustment mechanism included in the thermal printer 100 according to one embodiment.

In examples illustrated in FIGS. 6 to 8, the thermal printer 100 includes a first adjustment mechanism 110. The first adjustment mechanism 110 includes cams 111 and securing screws 112. The respective cams 111 are disposed on both ends of a rotational shaft 102A of a platen roller 102, and can be rotated with the rotational shaft 102A. Each cam 111 is disposed between a cylindrical roller portion of the platen roller 102 and a bearing 101A attached to a given sidewall of the frame 101. Each cam 111 is a disc-like member that has a certain thickness, and is provided separately from the bearing 101A. Each cam 111 is formed of a relatively rigid material such as resin. The center of rotation of each cam 111 is located to be away from the center of the cam 111. For this reason, a radius from the center of rotation of a given cam 111 differs depending on a rotation position.

An upper outer peripheral surface of each cam 111 contacts with the bottom of a plate 104. In such a manner, in accordance with each cam 111 being rotated, a distance from the center (in this example, a rotational shaft 102A of the platen roller 102) of rotation of the cam 111, to the bottom of the plate 104 is varied, so that a height of the plate 104 can be adjusted. A thermal head 105 is attached to the bottom of the plate 104. Thereby, in accordance with each cam 111 being rotated, a height of the plate 104 is varied, so that a distance of the thermal head 105 can be thereby varied. In other words, a gap between the thermal head 105 and the platen roller 102 can be adjusted.

Each securing screw 112 is attached to an outer surface of a given cam 111. Each securing screw 112 is provided through a given sidewall of the frame 101. By each securing screw 112 being inserted, a position in which a given cam 111 is rotated is set in a given sidewall of the frame 101. In other words, in a state in which a gap between the thermal head 105 and the platen roller 102 is adjusted to appropriate spacing in accordance with each cam 111 being rotated, the securing screws 112 are inserted, so that the first adjustment mechanism 110 illustrated in FIGS. 6 to 8 allows the above state to be maintained.

As described above, the first adjustment mechanism 110 allows a gap between the thermal head 105 and the platen roller 102 to be directly adjusted through the cams 111 each of which is interposed between the thermal head 105 and the platen roller 102. In other words, the first adjustment mechanism 110 allows the gap to be adjusted without using the frame 101. According to one embodiment, the thermal printer 100 includes the first adjustment mechanism 110, thereby adjusting the above gap to a suitable size. Accordingly, even in a case of long-term use of the thermal printer, it is possible to efficiently accurately maintain a size of a gap between the thermal head 105 and the platen roller 102, as well as an angle at which the thermal head 105 and a sheet front of the thermal paper P meet, without being affected by component accuracy, assembly accuracy, clearance, flexure, or the like of the frame 101.

(Second Example of Adjustment Mechanism)

Figure 9:
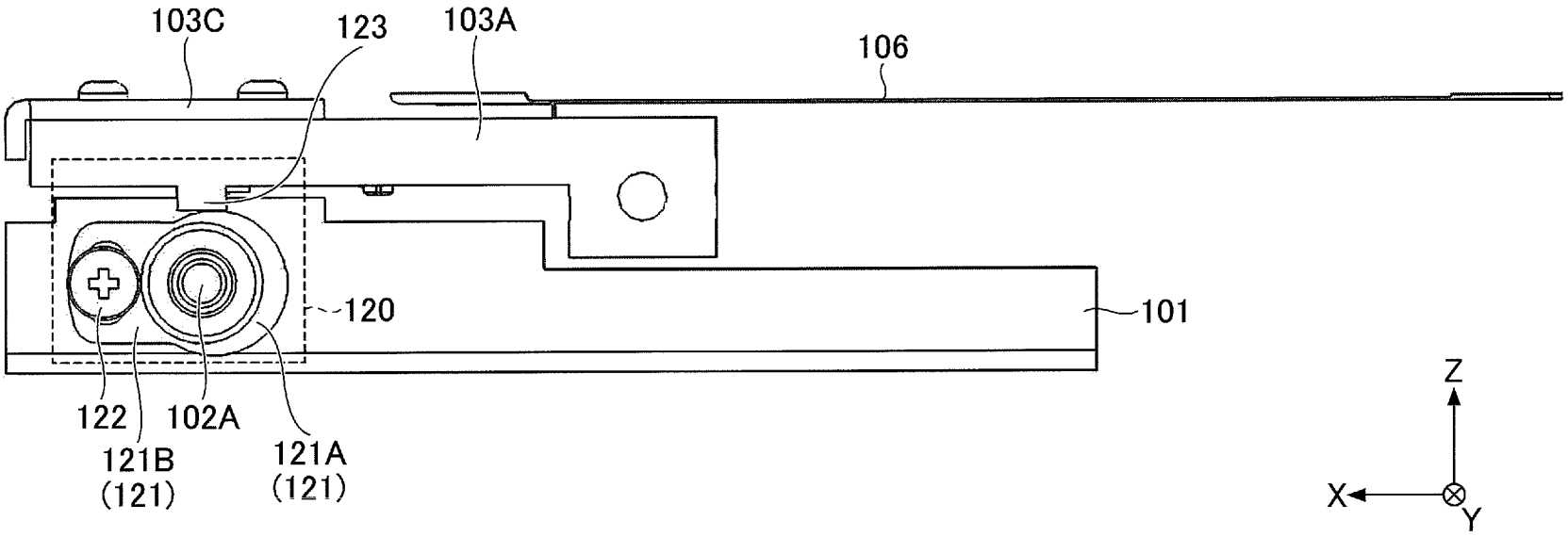
FIG. 9 is a side view of a second example of an adjustment mechanism included in the thermal printer according to one embodiment.
Figure 10:
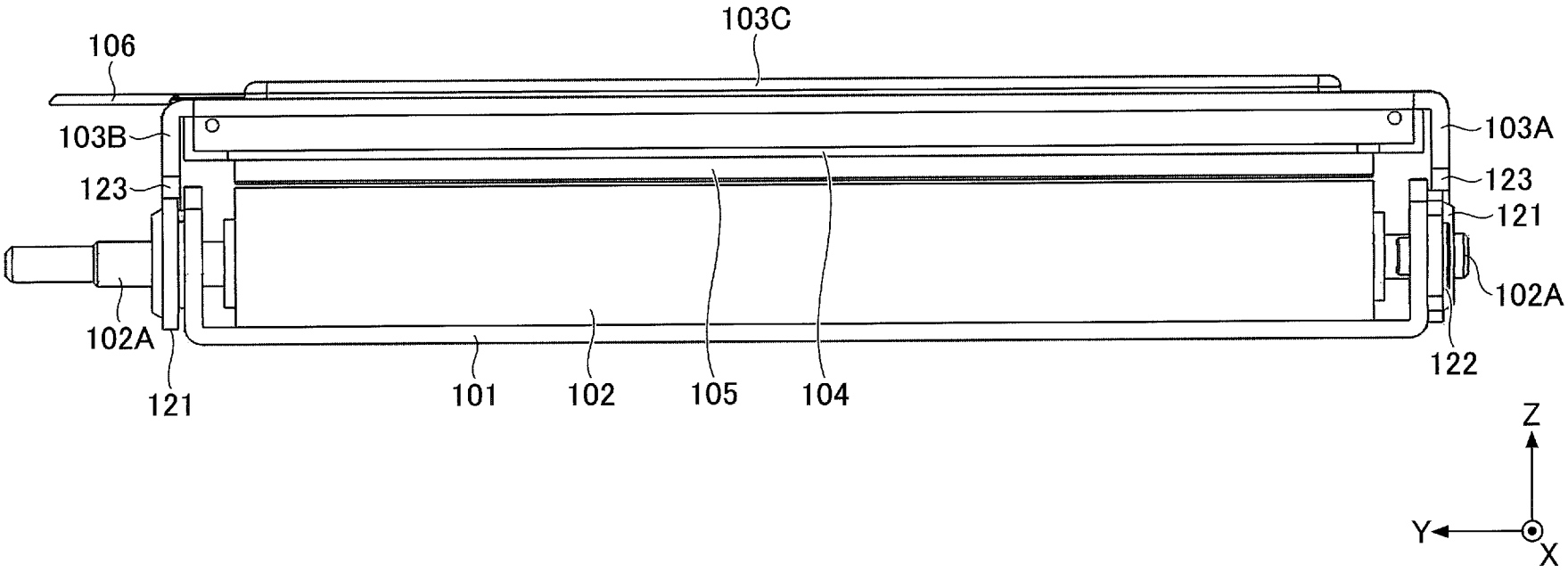
FIG. 10 is a front view of the second example of the adjustment mechanism included in the thermal printer according to one embodiment.
Figure 11:
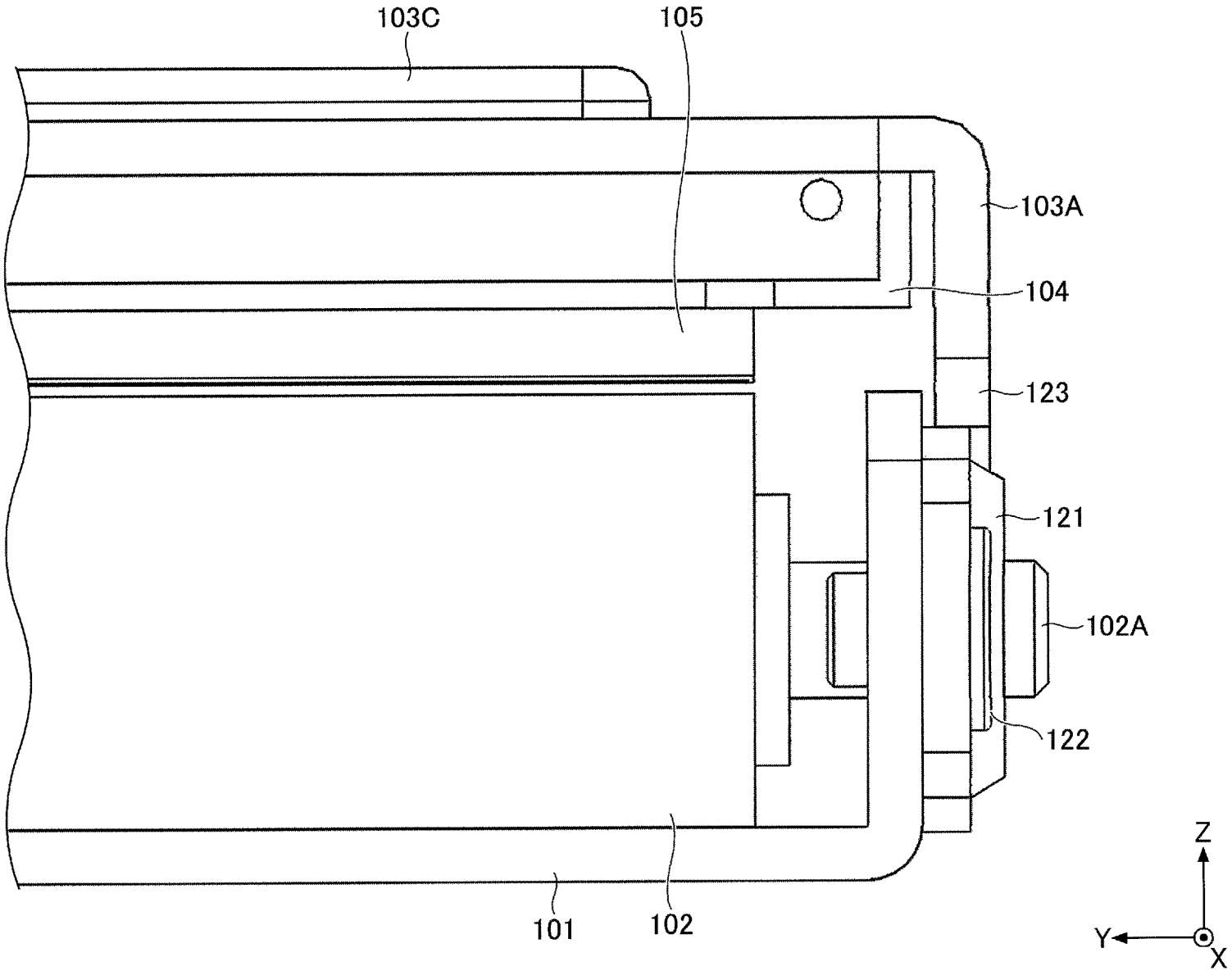
FIG. 11 is a partially enlarged view of the second example of the adjustment mechanism included in the thermal printer according to one embodiment.

Hereafter, a second example of an adjustment mechanism included in a thermal printer 100 will be described with reference to FIGS. 9 to 11. FIG. 9 is a side view of the second example of the adjustment mechanism included in the thermal printer 100 according to one embodiment. FIG. 10 is a front view of the second example of the adjustment mechanism included in the thermal printer 100 according to one embodiment. FIG. 11 is a partially enlarged view of the second example of the adjustment mechanism included in the thermal printer 100 according to one embodiment.

In examples illustrated in FIGS. 9 to 11, the thermal printer 100 includes a second adjustment mechanism 120. The second adjustment mechanism 120 includes cam levers 121, securing screws 122, and protrusions 123. The respective cam levers 121 are disposed on both ends of a rotational shaft 102A of a platen roller 102, and can be each rotated with the rotational shaft 102A. Further, each cam lever 121 is attached to a given sidewall of the frame 101. Each cam lever 121 serves as a bearing of the rotational shaft 102A. Each cam lever 121 is formed of a relatively rigid material such as resin.

Each cam lever 121 includes a cam portion 121A and a lever portion 121B that are in a location of protruding outside a given sidewall of the frame 101. Each cam portion 121A is a disc-like portion that has a certain thickness. The center of rotation of each cam portion 121A is located to be away from the center of the cam portion 121A. For this reason, a radius from the center of rotation of a given cam portion 121A differs depending on a rotation position.

The respective protrusions 123 that are protruded downwardly are provided at tip portions in the lower peripheries of arm portions 103A and 103B of a support member 103. An upper outer peripheral surface of each cam portion 121A contacts a tip portion of a given protrusion 123. In such a manner, in accordance with each cam portion 121A being rotated, a distance from the center (in this example, a rotational shaft 102A of the platen roller 102) of rotation of the cam portion 121A, to the tip portion of a given protrusion 123 is varied, so that a height of the support member 103 can be adjusted. A plate 104 and the thermal head 105 are attached to the support member 103. Thereby, in accordance with each cam portion 121A being rotated, a height of the support member 103 is varied, so that a distance of the thermal head 105 can be thereby varied. In other words, a gap between the thermal head 105 and the platen roller 102 can be adjusted.

Each securing screw 122 is attached to a given sidewall of the frame 101. Each securing screw 122 is provided through a given lever portion 121B. By each securing screw 122 being inserted, a position in which a given cam lever 121 is turned is set in a sidewall of the frame 101. In other words, in a state in which a gap between the thermal head 105 and the platen roller 102 is adjusted to approximate spacing in accordance with each cam portion 121A being rotated, the securing screws 122 are inserted, so that the second adjustment mechanism 120 illustrated in FIGS. 9 to 11 allows the above state to be maintained.

As described above, the second adjustment mechanism 120 allows a gap between the thermal head 105 and the platen roller 102 to be directly adjusted through the cam levers 121 each of which is interposed between the thermal head 105 and the platen roller 102. In other words, the second adjustment mechanism 110 allows the gap to be adjusted without using the frame 101. According to one embodiment, the thermal printer 100 includes the second adjustment mechanism 120, thereby adjusting the above gap to a suitable size. Accordingly, even in a case of long-term use of the thermal printer, it is possible to efficiently accurately maintain a size of a gap between the thermal head 105 and the platen roller 102, as well as an angle at which the thermal head 105 and a sheet front of the thermal paper P meet, without being affected by component accuracy, assembly accuracy, clearance, flexure, or the like of the frame 101.

(Third Example of Adjustment Mechanism)

Figure 12:
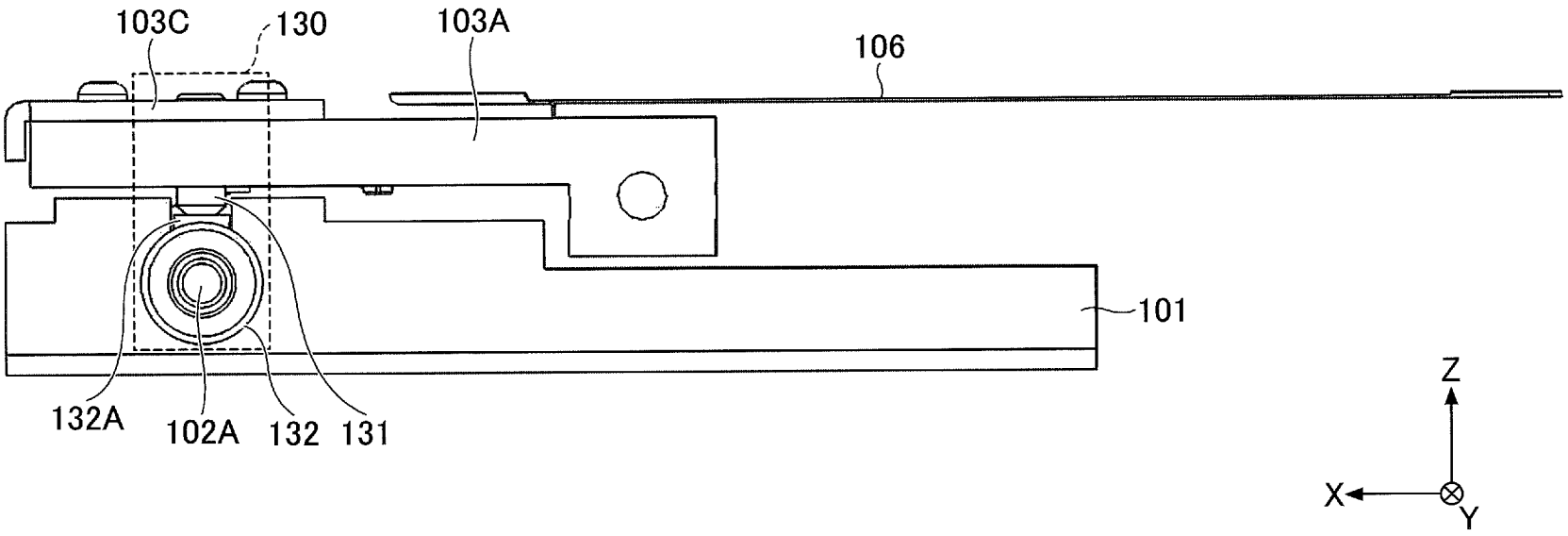
FIG. 12 is a side view of a third example of an adjustment mechanism included in the thermal printer according to one embodiment.
Figure 13:
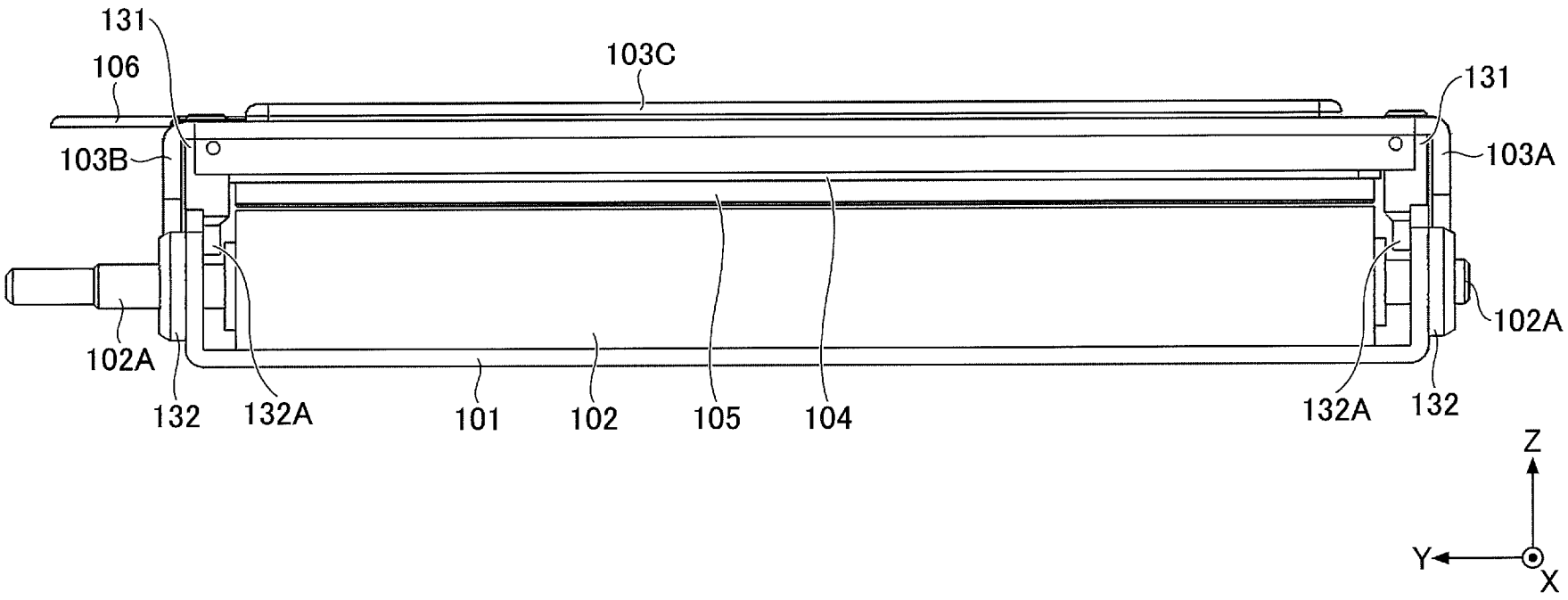
FIG. 13 is a front view of the third example of the adjustment mechanism included in the thermal printer according to one embodiment.
Figure 14:
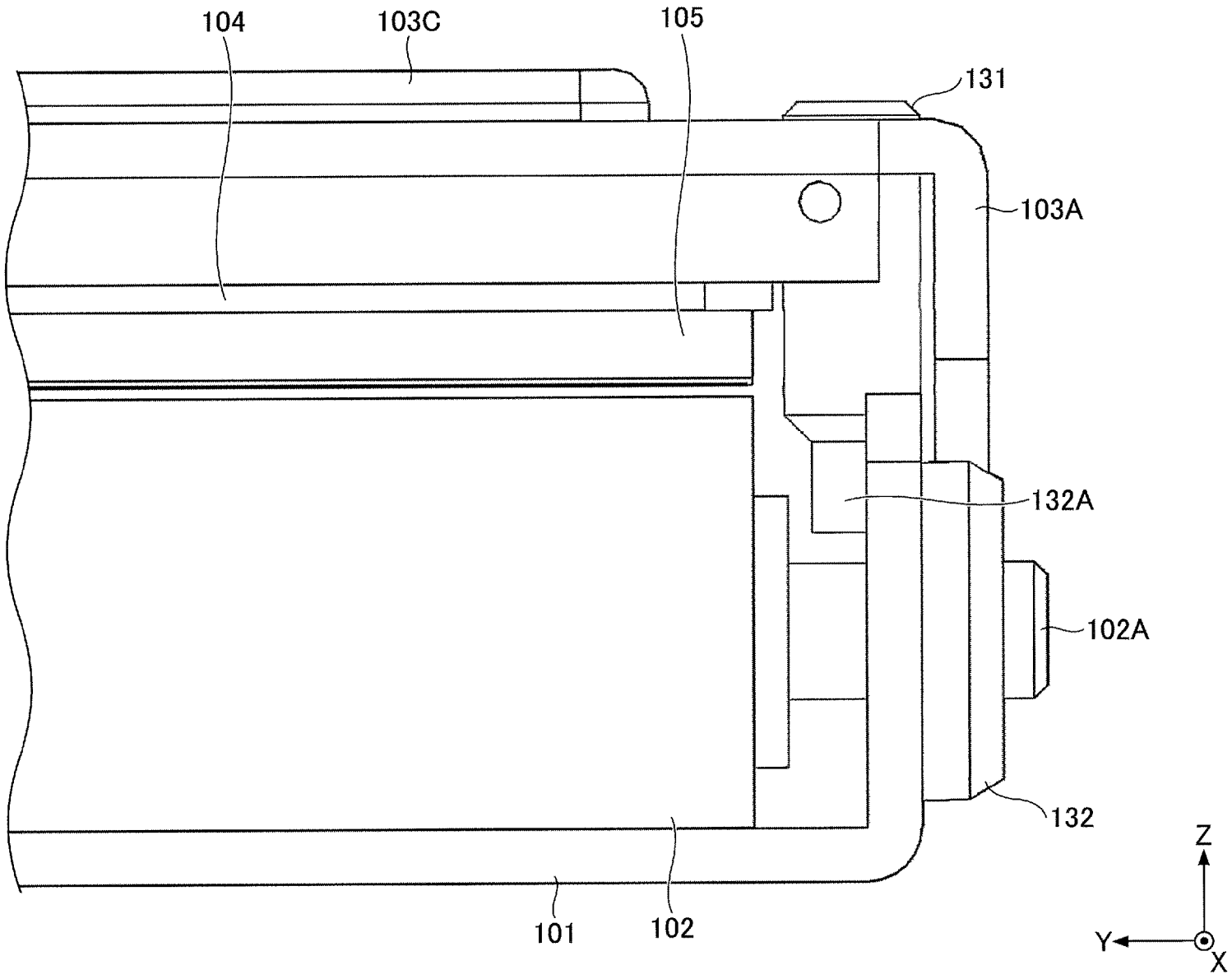
FIG. 14 is a partially enlarged view of the third example of the adjustment mechanism included in the thermal printer according to one embodiment.

Hereafter, a third example of an adjustment mechanism included in a thermal printer 100 will be described with reference to FIGS. 12 to 14. FIG. 12 is a side view of the third example of the adjustment mechanism included in the thermal printer 100 according to one embodiment. FIG. 13 is a front view of the third example of the adjustment mechanism included in the thermal printer 100 according to one embodiment. FIG. 14 is a partially enlarged view of the third example of the adjustment mechanism included in the thermal printer 100 according to one embodiment.

In examples illustrated in FIGS. 12 to 14, the thermal printer 100 includes a third adjustment mechanism 130. The third adjustment mechanism 130 includes adjustment screws 131 and bearings 132. On both ends of a connecting portion 103C of a support member 103, the respective adjustment screws 131 are provided so as to pass through the connecting portion 103C, from the top of the connecting portion.

The respective bearings 132 for pivotally supporting a rotational shaft 102A of a platen roller 102 are attached to right and left sidewalls of a frame 101. Each bearing 132 includes a restriction portion 132A that protrudes inside a given sidewall of the frame 101. Each bearing 132 is formed of a relatively rigid material such as resin.

When an amount of each adjustment screw 131 being inserted is adjusted, an amount of a given adjustment screw 131 protruding downwardly from the bottom of the connecting portion 103C in the support member 103 can be adjusted. Each adjustment screw 131 contacts a restriction portion 132A of a given bearing 132, at a tip portion of the adjustment screw. For this reason, a height of the support member 103 is set in accordance with an amount of each adjustment screw 131 being inserted. Thereby, in accordance with each adjustment screw 131 being rotated, an amount of a given adjustment screw 131 being inserted is adjusted, so that a height of the support member 103 can be thereby adjusted.

A plate 104 and a thermal head 105 are attached to the support member 103. In such a manner, in accordance with an amount of each adjustment screw 131 being inserted, a height of the support member 103 is adjusted, so that a height of the thermal head 105 can be thereby adjusted. In other words, a gap between the thermal head 105 and the platen roller 102 can be adjusted.

In a state in which a gap between the thermal head 105 and the platen roller 102 is adjusted to suitable spacing in accordance with each adjustment screw 131 being rotated, the third adjustment mechanism 120 illustrated in FIGS. 12 to 14 allows such a state to be maintained, as long as the adjustment screws 131 are not further turned.

As described above, the third adjustment mechanism 130 allows a gap between the thermal head 105 and the platen roller 102 to be directly adjusted through the adjustment screws 131 each of which is interposed between the thermal head 105 and the platen roller 102. In other words, the third adjustment mechanism 130 allows the gap to be adjusted without using the frame 101. According to one embodiment, the thermal printer 100 includes the first adjustment mechanism 110, thereby adjusting the above gap to a suitable size. Accordingly, even in a case of long-term use of the thermal printer, it is possible to efficiently accurately maintain a size of a gap between the thermal head 105 and the platen roller 102, as well as an angle at which the thermal head 105 and a sheet front of the thermal paper P meet, without being affected by component accuracy, assembly accuracy, clearance, flexure, or the like of the frame 101.

One or more embodiments of the present disclosure have been described above. However, the present disclosure is not limited to these embodiments, and various modifications or changes can be made within a scope of the present disclosure.

For example, the first adjustment mechanism 110 may be configured such that an upper outer peripheral surface of each cam 111 contacts a thermal head 105 or a support member 103.

For example, the second adjustment mechanism 120 may be configured such that an upper outer peripheral surface of a given cam portion 121A of each cam lever 121 contacts a thermal head 105 or a plate 104.

For example, the third adjustment mechanism 130 may be configured such that a tip portion of each adjustment screw 131 contacts a rotational shaft 102A of a platen roller 102.

For example, the third adjustment mechanism 130 may be configured such that adjustment screws 131 are disposed in a thermal head 105 or a plate 104.

Note that "components of a platen roller" include a rotational shaft of a platen roller; and bearings for pivotally supporting a rotational shaft of a platen roller. Additionally, "contact with one or more given components of a platen roller" means a case of contact with a rotational shaft of a platen roller; or a case of contact with bearings for pivotally supporting a rotational shaft of a platen roller.

Further, "components of a thermal head" include a thermal head; a plate for holding the thermal head; and a support member for holding the thermal head. Additionally, "contact with a given component of a thermal head" means a case of contact with a thermal head; a case of contact with a plate for holding the thermal head; or a case of contact with a support member for holding a thermal head.

What is claimed is:

1. A thermal printer comprising:

a frame including sidewalls;

a platen roller supported by the frame, through bearings, the platen roller being configured to rotate with a rotational shaft;

a thermal head disposed opposite the platen roller;

a support member for supporting the thermal head, the support member being configured to be pivoted with respect to the frame; and an adjustment mechanism disposed between the rotational shaft of the platen roller and the thermal head, the adjustment mechanism allowing a distance between the rotational shaft of the platen roller and the thermal head to be adjusted, while contacting at least one from among components of the platen roller and components of the thermal head, so that a gap between the thermal head and the platen roller is adjusted, the adjustment mechanism including:

cams each of which is coaxially arranged with the platen roller and each of which is disposed inside a given sidewall from among the sidewalls of the frame, each cam being configured to be rotated while an outer peripheral surface of each cam contacts a given component from among the components of the thermal head, thereby allowing the distance between the rotational shaft of the platen roller and the thermal head to be adjusted; and securing screws each of which is provided through a given sidewall of the frame, from outside the given sidewall, such that a given cam from among the cams is screwed.

2. A thermal printer comprising:

a frame including sidewalls;

a platen roller supported by the frame, through bearings, the platen roller being configured to rotate with a rotational shaft;

a thermal head disposed opposite the platen roller;

a support member for supporting the thermal head, the support member including sidewalls, the support member being configured to be pivoted with respect to the frame; and an adjustment mechanism disposed between the rotational shaft of the platen roller and the thermal head, the adjustment mechanism allowing a distance between the rotational shaft of the platen roller and the thermal head to be adjusted, while contacting at least one from among components of the platen roller and components of the thermal head, so that a gap between the thermal head and the platen roller is adjusted, the adjustment mechanism including:

cam levers including respective cam portions, the cam levers being used as the bearings, each cam lever being disposed outside a given sidewall from among the sidewalls of the frame;

protrusions each of which protrudes downwardly from a given sidewall from among the sidewalls of the support member, each cam portion being configured to be rotated, while an outer peripheral surface of each cam portion contacts a given protrusion from among the protrusions, thereby allowing the distance between the rotational shaft of the platen roller and the thermal head to be adjusted; and securing screws each of which is provided through a given cam lever from among the cam levers, from outside the given cam lever, such that the given cam lever is screwed into a given sidewall from among the sidewalls of the frame.

3. A thermal printer comprising:

a frame including sidewalls;

a platen roller supported by the frame, through bearings, the platen roller being configured to rotate with a rotational shaft;

a thermal head disposed opposite the platen roller;

a support member for supporting the thermal head, the support member including sidewalls, the support member being configured to be pivoted with respect to the frame; and an adjustment mechanism disposed between the rotational shaft of the platen roller and the thermal head, the adjustment mechanism allowing a distance between the rotational shaft of the platen roller and the thermal head to be adjusted, while contacting at least one from among components of the platen roller and components of the thermal head, so that a gap between the thermal head and the platen roller is adjusted, the adjustment mechanism including:

restriction portions each of which is integrally formed with a given bearing from among the bearings and each of which protrudes inside a given sidewall from among the sidewalls of the frame; and adjustment screws including respective tip portions, each adjustment screw being configured to be inserted into a given component from among the components of the thermal head, wherein the adjustment mechanism allows an amount of each adjustment screw being inserted to be adjusted, while the tip portions of the adjustment screws contact the respective restriction portions, thereby allowing the distance between the rotational shaft of the platen roller and the thermal head to be adjusted.

* * * * *